US006275597B1

(12) United States Patent
Roozen et al.

(10) Patent No.: US 6,275,597 B1
(45) **Date of Patent: *Aug. 14, 2001**

(54) LOUDSPEAKER SYSTEM HAVING A BASS-REFLEX PORT

(75) Inventors: Nicolaas B. Roozen, Eindhoven; Abraham Hirschberg, Veldhoven; Pascas Van Eck, Eindhoven, all of (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/316,982

(22) Filed: May 24, 1999

(30) Foreign Application Priority Data

May 27, 1998 (EP) ..... 98201777

(51) Int. Cl.[7] ..... H04R 25/00

(52) U.S. Cl. ..... 381/345; 381/349; 381/353; 181/156

(58) Field of Search ..... 381/345, 346, 381/348, 349, 353, 354, FOR 145, FOR 146; 181/155, 156, 146, 151, 152, 199, 160

(56) References Cited

U.S. PATENT DOCUMENTS

| | | | | |
|---|---|---|---|---|
| 5,012,890 | * | 5/1991 | Nagi et al. | 381/353 |
| 5,109,422 | | 4/1992 | Furukawa | 381/96 |
| 5,892,183 | | 4/1999 | Roozen et al. | 181/156 |

* cited by examiner

*Primary Examiner*—Huyen Le

(57) ABSTRACT

A loudspeaker system comprises an enclosure which accommodates a loudspeaker device and a bass-reflex port (105). The port has two open ends (105*b*, 105*c*) and a central area (c) provided with perforations (109), as well as a foam material (111) provided in and/or on the perforations.

17 Claims, 4 Drawing Sheets

Frequency ( Hz )

LOUDSPEAKER SYSTEM HAVING A BASS-REFLEX PORT

BACKGROUND OF THE INVENTION

The invention relates to a loudspeaker system comprising an enclosure which accommodates a loudspeaker device and a bass-reflex port, which port has two open ends and means for the suppression of noises.

A bass-reflex port is basically an open tube or pipe by means of which an internal volume of a loudspeaker enclosure communicates with an environment outside the enclosure, one open end being situated inside the enclosure and one open end being situated outside the enclosure. Such a port enhances the reproduction of sound in the lower range of the frequency spectrum. The operation of the bass-reflex port is based on the Helmholtz resonator principle, which is known per se, the frequency of the reproduced sound being dependent on the volume of the enclosure, the length and the cross-sectional dimension of the port and the velocity of sound. Small loudspeaker enclosures require a port of comparatively small cross-section. However, in a small enclosure, it is necessary that per unit of time the same amount of air flows through the port in order to obtain the same sound pressure at or near the Helmholtz frequency as in a large enclosure. This means that the flow velocity of the air in the port is comparatively high for a small enclosure. It has been found that when known bass-reflex ports are used, a high sound level at or near the Helmholtz frequency is attended by noises, i.e. undesired sounds.

U.S. Pat. No. 5,109,422 discloses a loudspeaker system, which comprises an enclosure with a loudspeaker and a bass reflex port made up of a plurality of parts. This bass reflex port comprises a visco-elastic part formed by two rubber outer cylinders disposed in line with one another and an air-permeable part formed by a felt inner cylinder, the inner cylinder extending between and for a substantial part in the outer cylinders, to which it is connected.

The bass-reflex port used therein serves to counteract undesired sounds, particularly duct resonant sounds. However, the multi-part port also forms a drawback of the known loudspeaker system because the manufacture of such a bass-reflex port is rather laborious owing to the necessity of positioning various parts relative to one another and subsequently securing them to one another.

It is an object of the invention to improve the known loudspeaker system so as to counteract undesired sounds in an effective and simple manner.

SUMMARY OF THE INVENTION

In accordance with the invention the means for the suppression of noises comprise a central area of the port, which area is situated centrally with respect to the open ends and has been provided with perforations, as well as a foam material provided in and/or on the perforations. For the sake of completeness, it should be noticed that the bass-reflex port has a circumferential wall, the perforations being consequently situated in this wall.

Undesired sounds arise in that air vortices are produced at the two open ends of the port. This effect occurs particularly in the case of small and slender ports which are usually employed in small enclosures. The vortices arising at the open ends of the port produce sound dominated by certain frequencies. These frequencies correspond to the so-called ½λ resonant frequency of the port and harmonics of this frequency. Undesired sounds produced at the ½λ resonant frequency are reduced effectively by the measure taken in the bass-reflex port of the loudspeaker system in accordance with the invention. The ½λ resonance exhibits a maximum pressure level in the center of the port but as a result of the perforations present in the central area the sound pressure remains limited owing to leakage of air through the perforations, the presence of the foam material providing the necessary damping. Experiments have shown that by the simple measures thus taken a substantial reduction of undesired sounds can be achieved, while the desired sound level can be maintained unchanged. Furthermore, it has been found that the measures taken have a favorable effect on the so-called Q factor of the port. For the sake of completeness, it is to be noted that this quality factor is a measure of the damping of sound. In the case of a favorable, i.e. comparatively low Q factor the decay time is comparatively short, as a result of which both desired sounds and undesired sounds are sustained for a shorter time.

The bass-reflex port, which essentially has the shape of a tubular body, can in principle be manufactured from any regular solid material such as a hard plastic, for example polystyrene. The basically hollow port can be of round or non-round cross-section. In principle, the foam material can be any regular porous air-permeable foam plastic, such as polyurethane foam, polyether foam and PVC foam, or air-permeable rubber.

It is to be noted that from JP-A 4 114598 a loudspeaker system of the bass-reflex type is known, which employs a pipe having a communication opening halfway its length. In this known system relatively many undesired sounds are produced, while the damping is comparatively low (high Q factor). Moreover, the known system only the ½λ resonance is suppressed.

In a practical embodiment of the loudspeaker system in accordance with the invention perforations are situated along the circumference of the central area of the port. In this embodiment the ½λ resonance is suppressed most effectively.

An embodiment of the loudspeaker system in accordance with the invention also suppresses noise by means of a non-central area, outside the central area, provided with perforations. The use of this embodiment also leads to a reduction of undesired sound caused by further resonant frequencies, particularly harmonics of the ½λ resonant frequency.

In a practical embodiment perforations are present along the circumference in one or more non-central areas situated outside the central area.

An embodiment of the loudspeaker system in accordance with the invention has a foam material in and/or on the perforations in the non-central area. The use of this embodiment makes it possible to achieve an optimum reduction of undesired sound caused by the ½λ resonant frequency and harmonics of this frequency.

In a simple to realize yet effective embodiment of the loudspeaker system in accordance with the invention the foam material takes the form of a layer surrounding the port and deposited on an outer wall of the port. Such a layer is obtained, for example by the provision of a collar or cuff of a foam material.

U.S. Pat. No. 5,892,183; describes a loudspeaker system of the bass-reflex type, in which measures have been taken inter alia to counteract acoustic losses and distortions of the reproduced sound. Applying these measures in the present loudspeaker system in accordance with the invention leads to further surprising improvements of the system. Thus, it has proved to be highly favorable to provide the port with a passage which flares towards the two open ends, flared portions being provided, which portions extend over a substantial part of the length of the port and, in a longitudinal section of the port, have bounding lines which extend at an angle having a value of between 3° and 12° with respect to the longitudinal axis of the port. Such a port consequently has inner walls which are slightly inclined with respect to its longitudinal axis.

The use of this measure leads to a higher sound reproduction level at low frequencies and a further reduction of noises. This is caused in particular by the fact that the air stream in the port can follow the slightly inclined inner walls of the port for a long time without the passing air being separated from the wall. As a result of this, annoying vortex motions of the air and noises, acoustic losses and distortions attending these can be minimized. Furthermore, experiments have shown that a value of between 3° and 6° produces only minimal noises and acoustic losses at the Helmholtz frequency, particularly if the bass-reflex port has a length dimension and, in the case of a round port, a smallest diameter of the order of magnitude of 13 cm and 2 cm, respectively, while the volume of the enclosure is comparatively small, for example 2.5 $dm^3$. Moreover, it has appeared that bounding lines of parabolic shape this promotes that the air which passes through the port in operation follows the walls of the port for a prolonged time. It has further been found that it is favorable if both open ends of the port have end portions which are radially rounded towards the exterior. Such rounded end portions promote that the air, as it leaves the port, remains on the wall for such a long time that separation does not take place until an area is reached where the air velocity has already decreased considerably. For realistic air velocities in the port this only results in comparatively slight turbulences near the ends of the port, which only give rise to minimal noises and acoustic losses. Since the air stream is pulsating, i.e. constantly changes direction, it is important that both open ends are rounded. It has been found that the most favorable aerodynamic effects are achieved if the rounded end portions have a radius of between 3 and 10 mm. The rounded end portions at both open ends, which portions adjoin the slightly inclined inner walls, may change into flanges situated outside the port, for example flanges which are oriented transversely to the longitudinal axis of the port. This measure may yield a further improvement of the loudspeaker system at certain sound levels. One of the flanges can be integrated in a wall portion of the enclosure.

DETAILED DESCRIPTION OF THE PREFERRED EMBODIMENTS

Figure 1:
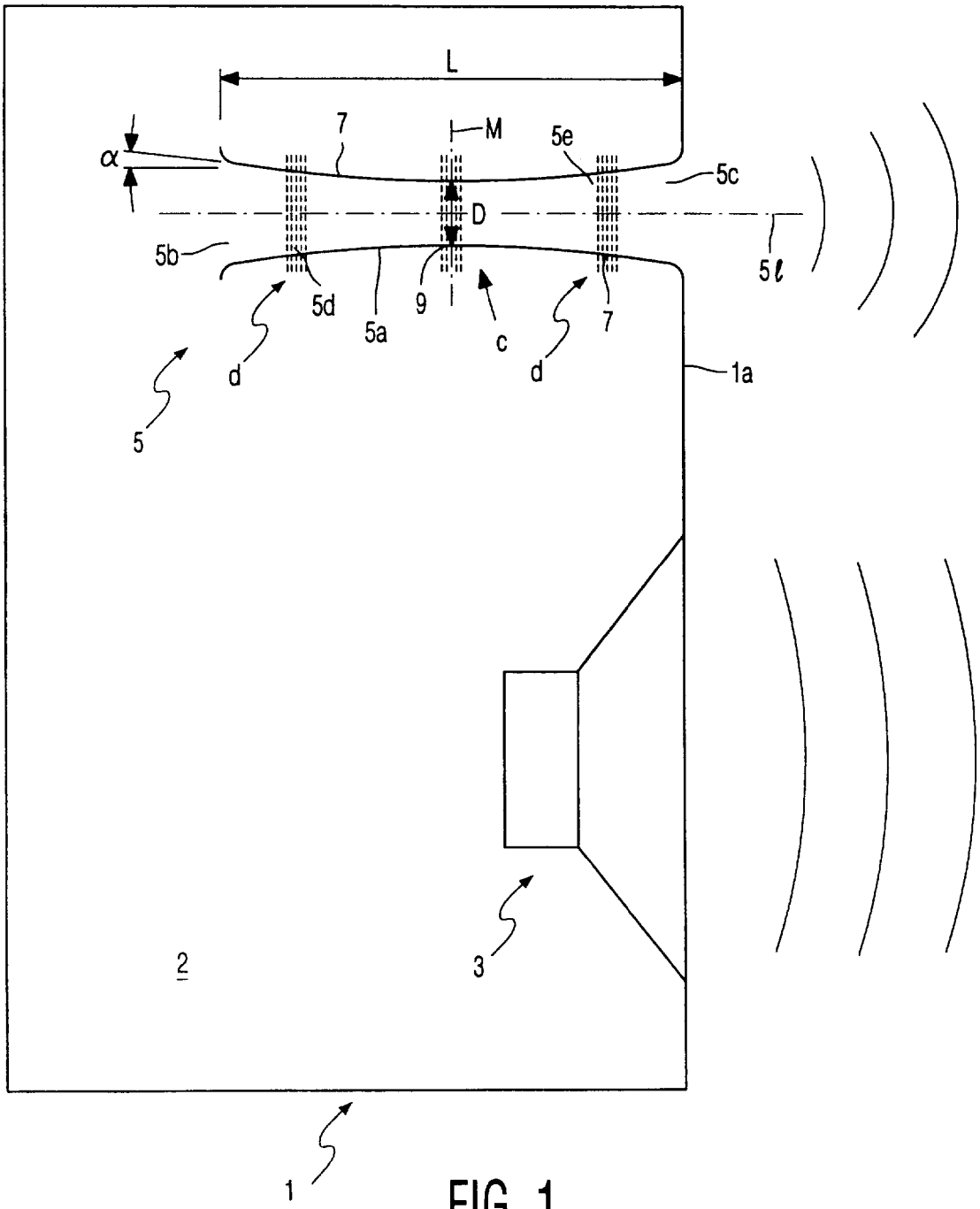
FIG. 1 diagrammatically shows an embodiment of the loudspeaker system in accordance with the invention, FIGS. 2 through 4*a* diagrammatically show embodiments of bass-reflex ports suitable for use in the loudspeaker system in accordance with the invention.

The loudspeaker system in accordance with the invention shown in FIG. 1 comprises an enclosure 1 which accommodates a loudspeaker device 3, taking the form of a cone loudspeaker known per se, and a bass-reflex port 5. The enclosure 1 forms a chamber 2 of a given volume, for example 2.5 $dm^3$. The port 5, which provides open communication between the chamber and an environment of the enclosure, has a wall 5*e* and a longitudinal axis 5*l*. The port 5 has two open ends 5*b* and 5*c*, of which one end 5*b* is situated inside the enclosure and the other end 5*c* is situated on or near an outer side, particularly a wall portion 1*a* of the enclosure 1. The port 5 in the present example has a length L of 13 cm and a round cross-section having a minimum diameter D of 2 cm. The port together with the enclosure forms a Helmholtz resonator, but also acts as a so-called ½λ pipe, the first resonant frequency having a wavelength which is substantially equal to twice the port length. The port 5, by way of example, has a passage which flares towards the two open ends 5*b* and 5*c*, while the port may have bounding lines 7 of parabolic shape in longitudinal section. A flared portion 5*d* and a flared portion 5*e* are present at opposite sides of the center M of the port, which flared portions widen towards an open end 5*b* or 5*c* and extend over a substantial part of the port length L. The parabolic bounding lines 7 extend at an angle α of maximum 12° with respect to the longitudinal axis 5*l*. In a central area c which as shown has a substantially constant cross section, situated near the center M the port has perforations 9 formed in the wall 5*a*, which perforations are shown diagrammatically in broken lines in FIG. 1. In or on these perforations a foam material is present. Furthermore, perforations 9 may be provided in one or more non-central areas d between the center M and the open ends 5*b* and 5*c*. The perforated areas in combination with the foam material form an effective means for the suppression of noises.

Figure 2:
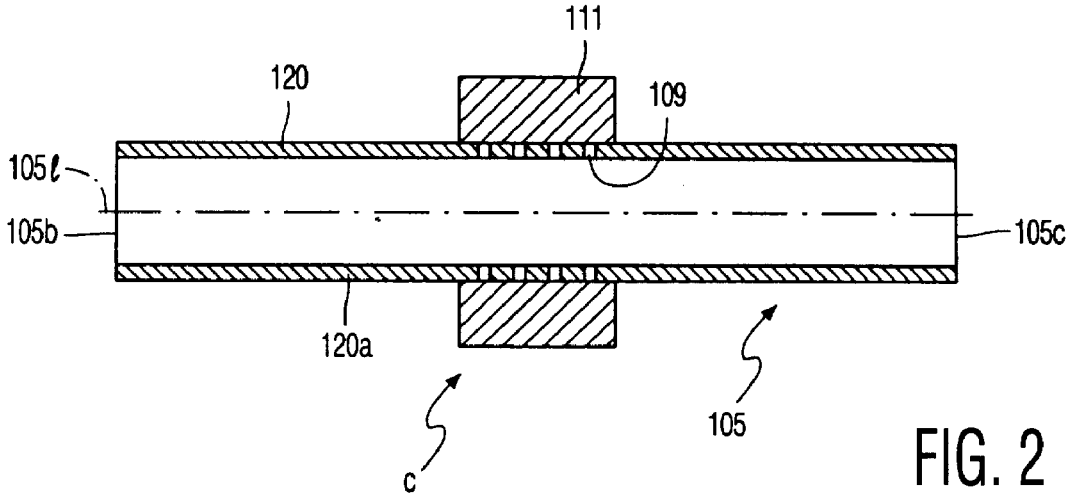

The bass-reflex port 105 shown in FIG. 2, which is intended for use in a loudspeaker system in accordance with the invention, comprises a tubular body 120 of a hard material such as a hard plastic, in the present case in the form of a hollow cylinder, having a longitudinal axis 1051 and a wall 120*a*, in the present example a cylindrical wall.

The port 105 further has two open ends 105*b* and 105*c*. In an area c which is situated centrally with respect to the open ends, the wall 120*a* has perforations 109 in the form of small through-holes in the wall, the perforations being uniformly spaced along the circumference of the port. As shown in the drawing, the perforations 109 are also spaced longitudinally in the central area. A collar 111 of an air-permeable foam material, such as a polyurethane foam, surrounds the central area c.

Figure 3:
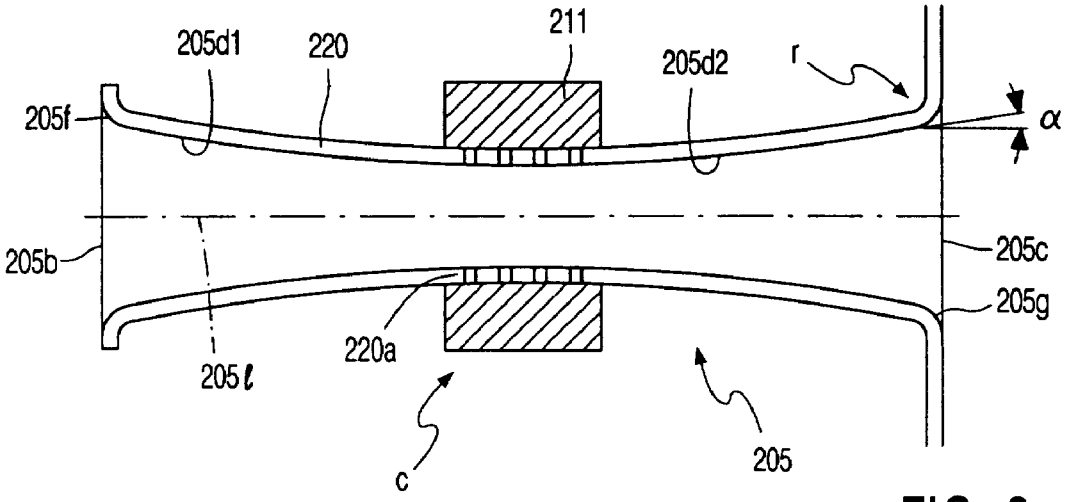

The bass-reflex port 305 shown in FIG. 3 has a wall 220 which surrounds a longitudinal axis 2051 and which has inner surfaces 205*d*1 and 205*e*1, respectively, which are slightly inclined with respect to the longitudinal axis 205*l*. In the present example, these surfaces extend at an angle α of maximum 6° with respect to the longitudinal axis 205*l*. At both open ends 205*b* and 205*c* the port 205 has end portions 205*f* and 205*g*, respectively, which are radially rounded towards the exterior and which in the present example have a radius r of approximately 5 mm. A slightly smaller or greater radius of, preferably between 3 and 10 mm, is also suitable. The rounded end portions 205*f* and 205*g* smoothly adjoin the gently inclined surfaces 205*d*1 and 205*e*1, respectively. In a central area c the port has a perforated wall portion 220*a* around which a cuff 211 of a foam material, such as porous rubber, is arranged. As is shown clearly in FIG. 3, the central area c has a substantially constant cross-section, and the inner surfaces of the passage through the port are free from foam.

Figure 4:
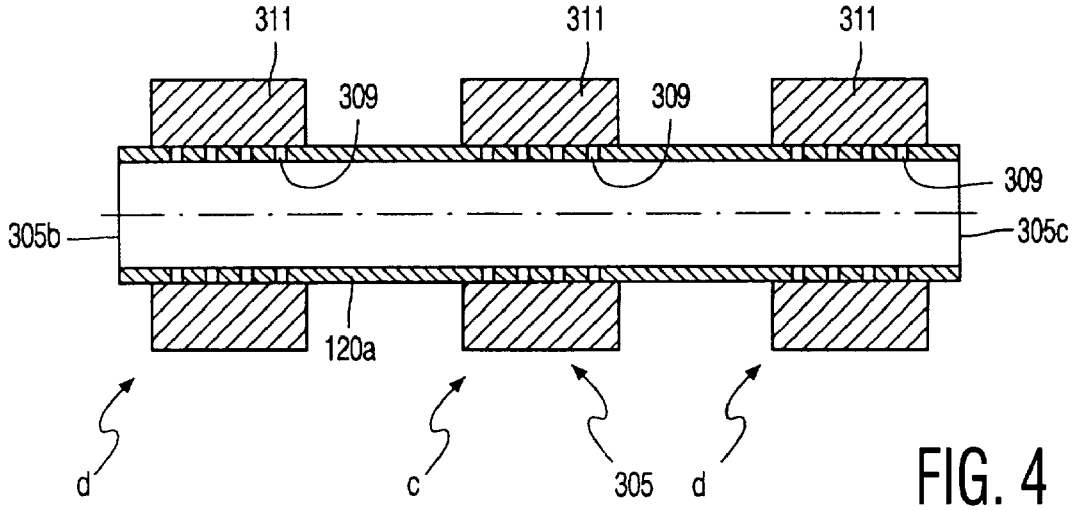

The bass-reflex port 305 shown in FIG. 4 has two open ends 305*b* and 305*c*. A central part c and two non-central parts d have perforations 309 and have a foam material 311, such as a polyester foam, in and/or on the perforations 309.

Figure 4A:
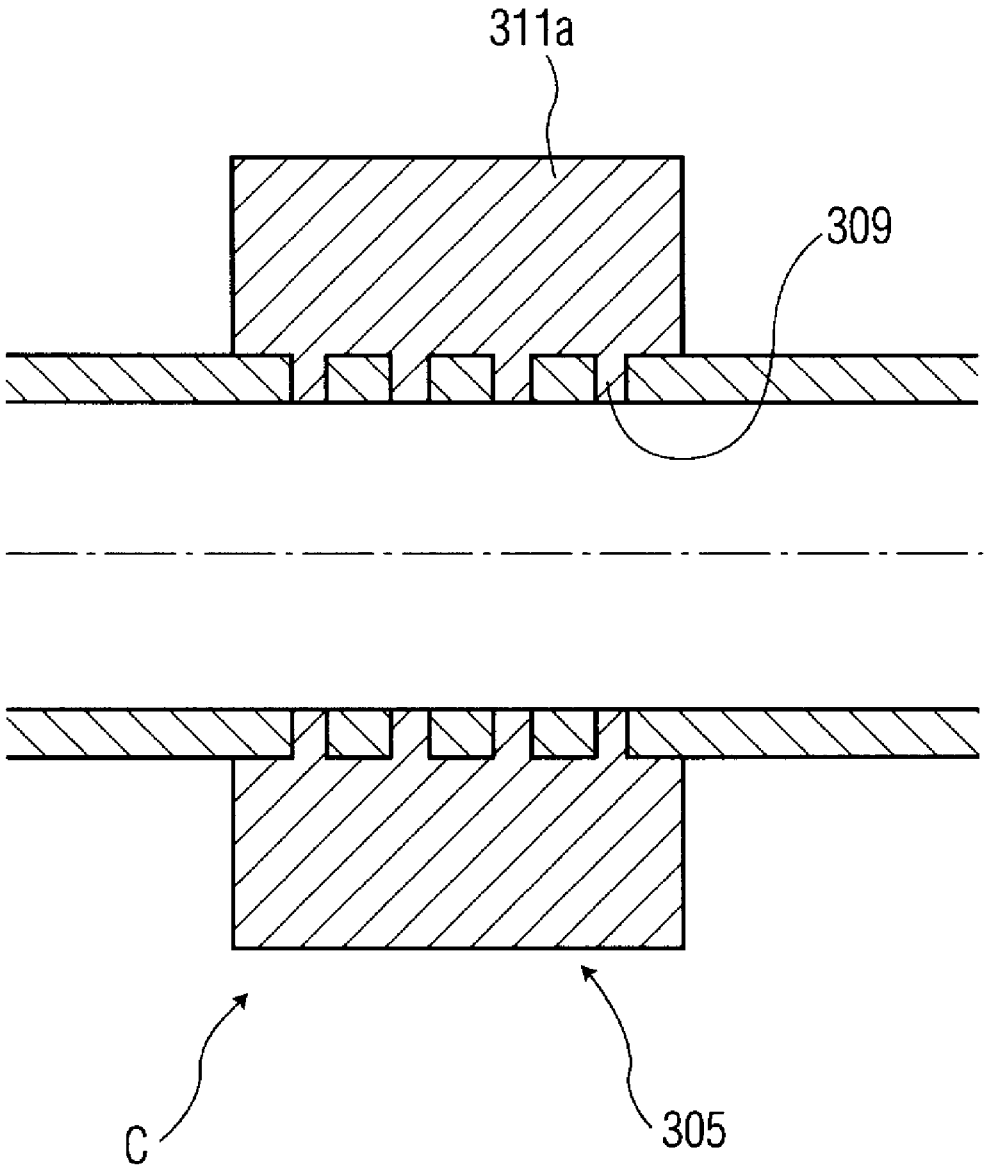

In the example of this figure, annular layers of a foam material have been provided around the port, and it is clear that the interior of the port is free from foam material. FIG. 4*a* shows an enlargement of the central part, differing from FIG. 4 in that the foam 311*a* is also in the perforations 309.

Figure 5A:
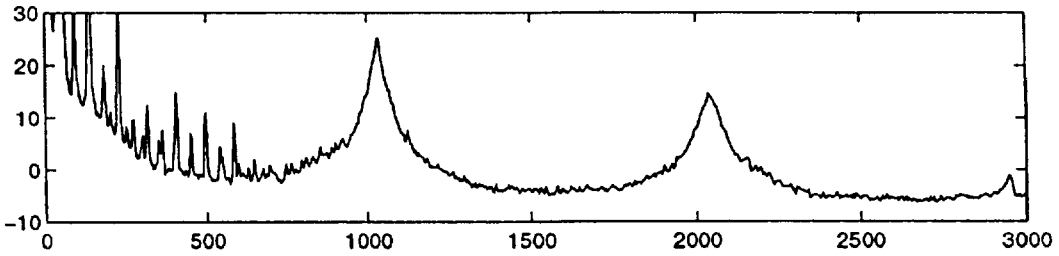
FIG. 5A PRIOR ART
FIGS. 5*a*–5*c* are graphs representing the sound pressure as a function of the frequency.
Figure 5B:
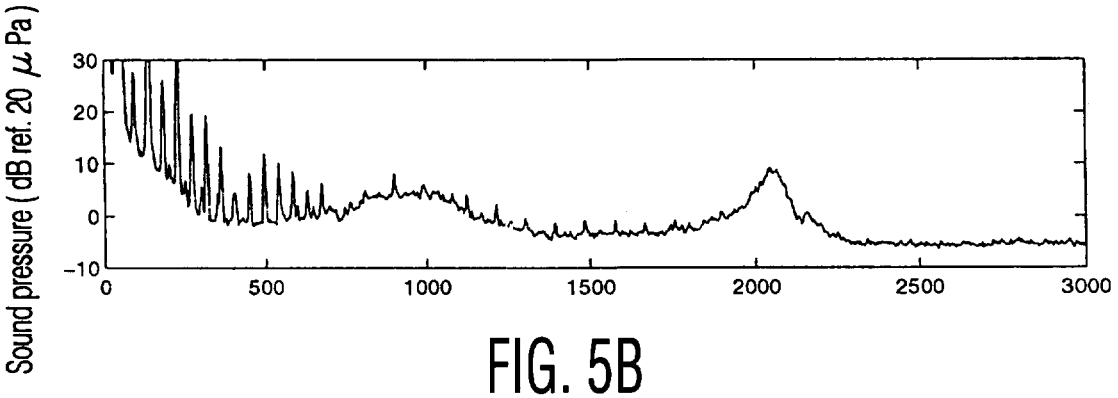
Figure 5C:
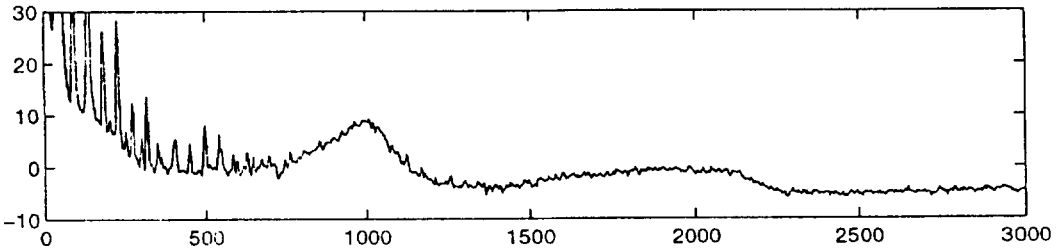

FIGS. 5*a*–5*c* successively show results of measurements carried out on a loudspeaker system including a conventional bass-reflex port, a bass-reflex port as shown in FIG. 2 and a bass-reflex port as shown in FIG. 4. During the measurements the sound pressure was measured at a position situated at a distance of 1 meter from the system. The driving frequency was 45 Hz.

The graphs represent the air pressure as a function of the frequency. FIG. 5*a* relates to measurements when the conventional port, i.e. a port without perforations, has been provided. FIG. 5*b* relates to measurements when a port as shown in FIG. 2 has been provided. FIG. 5*c* relates to measurements when a port as shown in FIG. 4 has been provided.

As is apparent from the graph, the noises are dominated by two port resonances, namely at approximately 1 kHz and approximately 2 kHz. When a port is used which has a perforated central area provided with a foam material at this location (curve $c_2$), the noise at 1 kHz appears to be reduced by approximately 20 dB and at 2 kHz by approximately 5 dB. When a port is used which, in addition, has perforated non-central areas provided with a foam material at this location (curve $C_3$), a substantially equal noise reduction is obtained at 1 kHz but a reduction of approximately 15 dB is obtained at 2 kHz.

It is to be noted that the invention is not limited to the embodiments disclosed herein by way of example. For example, ports of non-round cross-section or ports having end portions of a foam material are possible . With regard to the Claims, it is to be noted that various combinations of measures defined in the dependent Claims are possible.

What is claimed is:

1. A loudspeaker system comprising an enclosure which accomodates a loudspeaker device and a bass-reflex port, said port being a tubular body formed of a single solid material defining a passage extending along a longitudinal axis betwen two open ends, said tubular body having a central area and two other portions, said central area being situated centrally with respect to the open ends, and each of said other portions having a longitudinal length greater than the length of the central area, characterized in that said central area is provided with a plurality of perforations spaced longitudinally and circumferentially about the passage, each of the other portions is provided with perforations spaced from the central area, and the port includes a foam material in and/or on the perforations, said passage being free from said foam material.

2. A loudspeaker system as claimed in claim 1, characterized in that each of the other portions has a plurality of said perforations spaced longitudinally and circumferentially about the passage.

3. A loudspeaker system as claimed in claim 2, characterized in that the foam material is a layer surrounding the port and deposited on an outer wall of the port.

4. A loudspeaker system as claimed in claim 1, characterized in that the foam material is a layer surrounding the port and deposited on an outer wall of the port.

5. A loudspeaker system comprising an enclosure which accomodates a loudspeaker device and a bass-reflex port, said port being a tubular body formed of a single solid material defining a passage extending along a longitudinal axis betwen two open ends, said tubular body having a central area and two flared portions, said central area being situated centrally with respect to the open ends, and each of said flared portions having a longitudinal length greater than the length of the central area and flaring outwardly from said central area toward a respective open end, characterized in that said central area is provided with perforations, and the port includes a foam material in and/or on the perforations, said passage being free from said foam material.

6. A loudspeaker system as claimed in claim 5, characterized in that in said flared portions the passage has parabolic longitudinally extending bounding lines.

7. A loudspeaker system as claimed in claim 6, characterized in that said perforations in said central area are a plurality of longitudinally and circumferentially spaced perforations.

8. A loudspeaker system as claimed in claim 7, characterized in that said bounding lines have a maximum angle of 12° with respect to said axis.

9. A loudspeaker system as claimed in claim 7, characterized in that each of said flared portions is provided with a plurality of circumferentially spaced perforations spaced from the central area and from the respective end.

10. A loudspeaker system as claimed in claim 7, characterized in that the foam material is a layer surrounding the port and deposited on an outer wall of the port.

11. A loudspeaker system as claimed in claim 10, characterized in that each of said flared portions is provided with a plurality of circumferentially spaced perforations spaced from the central area and from the respective end.

12. A loudspeaker system comprising an enclosure which accomodates a loudspeaker device and a bass-reflex port, said port being a tubular body formed of a solid material defining a passage extending along a longitudinal axis betwen two open ends, said tubular body having a central area and two flared portions, said central area being situated centrally with respect to the open ends and having a substantially constant cross-section with less flare than the flared portions, each of said flared portions having a longitudinal length greater than the length of the central area and flaring outwardly from said central area toward a respective open end, and said flared portions having longitudinally extending bounding lines extending at an angle having a value between 3° and 12° with respect to the longitudinal axis, characterized in that said central area is provided with perforations, and the port includes a foam material in and/or on the perforations, said passage being free from said foam material.

13. A loudspeaker system as claimed in claim 12, characterized in that the foam material is a layer surrounding the port and deposited on an outer wall of the port.

14. A loudspeaker system as claimed in claim 12, characterized in that said perforations in said central area are a plurality of longitudinally and circumferentially spaced perforations.

15. A loudspeaker system as claimed in claim 14, characterized in that each of said flared portions is provided with a plurality of circumferentially spaced perforations spaced from the central area and from the respective end.

16. A loudspeaker system as claimed in claim 15, characterized in that the foam material is a layer surrounding the port and deposited on an outer wall of the port.

17. A loudspeaker system as claimed in claim 16 characterized in that said bounding lines are parabolic.

* * * * *